United States Patent [19]

Oka et al.

[11] 4,334,497

[45] Jun. 15, 1982

[54] MAGNETIC BRUSH DEVELOPING APPARATUS

[75] Inventors: Tateki Oka; Kenichi Wada; Kenji Tabuchi, all of Sakai, Japan

[73] Assignee: Minolta Camera Kabushiki Kaisha, Japan

[21] Appl. No.: 191,121

[22] Filed: Sep. 26, 1980

[30] Foreign Application Priority Data

Oct. 11, 1979 [JP] Japan ..... 54/131368

[51] Int. Cl.[3] ..... G03G 15/09

[52] U.S. Cl. ..... 118/698; 118/657

[58] Field of Search ..... 118/657, 658, 698

[56] References Cited

U.S. PATENT DOCUMENTS 4,235,194 11/1980 Wada et al. ..... 118/657

*Primary Examiner*—Bernard D. Pianalto

*Attorney, Agent, or Firm*—Wenderoth, Lind & Ponack

[57] ABSTRACT

The present invention provides a magnetic brush developing apparatus for developing latent electrostatic images with a particulate magnetic developer which comprises:

(a) a rotatable non-magnetic developing sleeve, (b) first drive means connected to said sleeve for rotating said developing sleeve in a specified direction, (c) a magnetic roller rotatably disposed within the developing sleeve, (d) second drive means connected to said magnetic roller for rotating the magnetic roller in the same direction as the developing sleeve to transport said magnetic developer along the peripheral surface of the developing sleeve in a direction opposite to the direction of rotation of the developing sleeve, (e) a brush bristle height adjusting plate member having one end in pressing contact with the peripheral surface of said sleeve and a developer guide surface at an acute angle with respect to a tangent to said sleeve, said tangent extending in the direction of rotation of said sleeve, for scraping developer particles moving in the direction of rotation of said sleeve, from said sleeve and (f) a developer supplying means for supplying developer particles, through said developer guide surface of said brush bristle height adjusting plate member, to the peripheral surface of said sleeve to form bristle thereon; and whereby the length of the magnetic brush bristles formed by application of the developer particles to said sleeve can be controlled by adjusting the relative rate of rotation of said magnetic roller with respect to said sleeve.

7 Claims, 6 Drawing Figures

MAGNETIC BRUSH DEVELOPING APPARATUS

BACKGROUND OF THE INVENTION

The present invention relates to a magnetic brush developing apparatus for use in electrographic copying machines and the like, and more particularly to a magnetic brush developing apparatus for developing latent electrostatic images with a magnetic developer.

Conventional methods of developing latent electrostatic images are divided into two general categories: dry and wet. Dry developing methods are further divided into two types: those in which two-component developers are used, and those in which mono-component developers are used. Magnetic developers, whether of the two-component type or of the mono-component type, have been predominantly used in recent developing methods.

For use in developing methods which employ such magnetic developers, magnetic brush developing apparatus are known which include a nonmagnetic developing sleeve having a magnetic roller incorporated therein. In such apparatus, the developer is transported on the sleeve by rotating the sleeve or the internal magnetic roller, or by rotating both the sleeve and the roller at the same time.

With magnetic brush developing apparatus of the type mentioned, the thickness of the developer layer on the sleeve, namely the bristle height of the magnetic brush, is adjusted usually by the use of a restricting plate 4 or restricting roller 5 as shown in FIG. 1 or 2. Indicated at 1 in FIGS. 1 and 2 is a developing sleeve, at 2 a magnetic roller rotatably housed in the sleeve 1, and at 3 a developer hopper. By the rotation of the sleeve 1 and/or the magnetic roller 2, a developer 13 is transported on the sleeve 1 counterclockwise to a developing position C and made into a layer of specified thickness by the restricting plate 4 or restricting roller 5 in the course of transport.

However, the magnetic brush developing apparatus in which the bristle height is restricted by this method has the following problems.

(1) Developer particles are likely to agglomerate or cake between the restricting member and the sleeve, thus failing to form a uniform developer layer.

(2) Especially when the apparatus is adapted to transport the developer by the rotation of the magnetic roller, the force of transport, which is created by the revolution of the developer, is small and is therefore greatly influenced by the force of the restricting member acting against the transport, so that the developer is likely to form an uneven layer as stated in paragraph (1). Consequently, such developing apparatus has difficulties in effecting satisfactory development.

(3) The restricting plate, roller or like rigid body must be held at a specified distance from the sleeve and made delicately adjustable for the restriction of the bristle height, using a mechanically complex arrangement.

SUMMARY OF THE INVENTION

The main object of the present invention is to provide a novel and useful magnetic brush developing apparatus.

Another object of the invention is to provide a magnetic brush developing apparatus which employs a novel method of adjusing the bristle height.

Another object of the invention is to provide a magnetic brush developing apparatus which has overcome the foregoing problems.

Another object of the invention is to provide a magnetic brush developing apparatus in which the developer on a developing sleeve is adjustable to a uniform bristle height without subjecting the developer to any mechanical pressure.

Another object of the invention is to provide a magnetic brush developing apparatus in which the developer on the developing sleeve is adjustable to a uniform bristle height although the developer is transported chiefly by the rotation of a magnetic roller.

Still another object of the invention is to provide a magnetic brush developing apparatus in which the developer on the developing sleeve is adjustable delicately and easily to the desired bristle height.

These and other objects of the invention are fulfilled by a magnetic brush developing apparatus comprising a magnetic brush developing apparatus for developing latent electrostatic images with a particulate magnetic developer which comprises:

(a) a rotatable non-magnetic developing sleeve, (b) first drive means connected to said sleeve for rotating said developing sleeve in a specified direction, (c) a magnetic roller rotatably disposed within the developing sleeve, (d) second drive means connected to said magnetic roller for rotating the magnetic roller in the same direction as the developing sleeve to transport said magnetic developer along the peripheral surface of the developing sleeve in a direction opposite to the direction of rotation of the developing sleeve, (e) a bristle height adjusting plate member having one end in pressing contact with the peripheral surface of said sleeve and a developer guide surface at an acute angle with respect to a tangent to said sleeve, said tangent extending in the direction of rotation of said sleeve, for scraping developer particles moving in the direction of rotation of said sleeve, from said sleeve and (f) a developer supplying means for supplying developer particles, through said developer guide surface of said bristle height adjusting plate member, to the peripheral surface of said sleeve to form bristle thereon; and whereby the length of the magnetic brush bristles formed by application of the developer particles to said sleeve can be controlled by adjusting the relative rate of rotation of said magnetic roller with respect to said sleeve.

Stated more specifically, the developing sleeve of the magnetic brush developing apparatus is rotatable by the first drive means at a variable speed. The magnetic roller is rotatable by the second drive means also at a variable speed. The magnetic action of the magnet roller on the developer is exerted on the developer supplied onto the developer guide surface of the bristle height adjusting plate member to guide the developer along the guide surface of the bristle height adjusting plate member to the peripheral surface of the developing sleeve with the rotation of the magnetic roller.

The magnetic brush developing apparatus is further provided with means for associating the rotational speeds of the developing sleeve and the magnetic roller with each other to transport the developer at a constant speed along the sleeve peripheral surface, whereby the developer on the sleeve is adjustable to the desired bristle height while being transported at the constant speed. The developer supplying means comprises a developer supplying plate member by which the developer transported along the peripheral surface of the developing sleeve toward the location of the developer supplying plate member is scraped off the sleeve peripheral surface and is guided onto the developer guide surface of the bristle height adjusting plate member.

These and other objects, advantages and features of the invention will become apparent from the following description thereof taken in conjunction with the accompanying drawings which illustrate specific embodiments of the invention.

BRIEF DESCRIPTION OF THE DRAWINGS

FIG. 4 (B) is a graph showing the relation between the rotational speed of the developing sleeve of the embodiment and the bristle height.

In the following description, like parts are designated by like reference numbers throughout the several drawings.

DETAILED DESCRIPTION OF THE INVENTION

Figure 1:
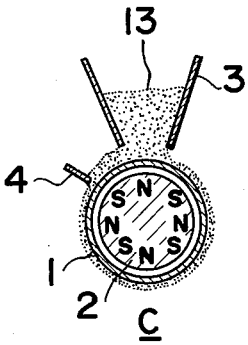
FIG.1 PRIOR ART
FIGS. 1 and 2 are diagrammatic sectional views showing magnetic brush developing apparatus in which the bristle height is adjusted by a conventional method.
Figure 2:
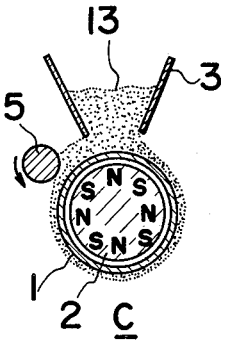
FIG.2 PRIOR ART
Figure 3:
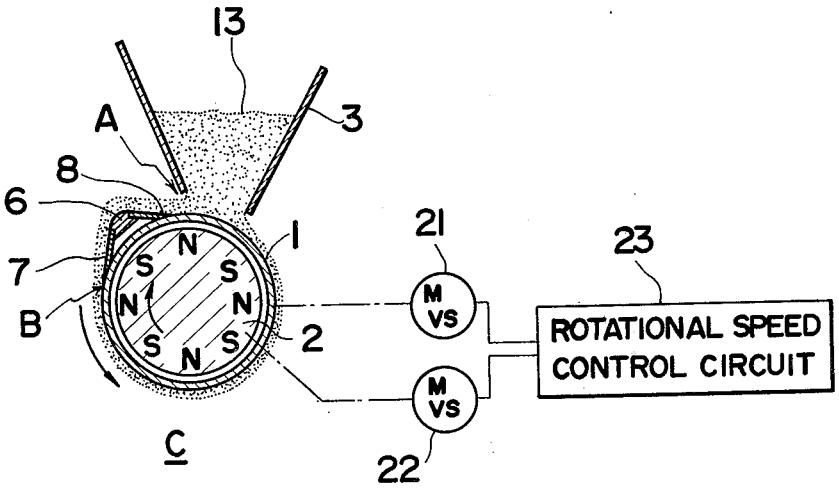
FIG. 3 is a diagrammatic sectional view showing an embodiment of the magnetic brush developing apparatus according to the present invention.

With reference to FIG. 3 showing an embodiment of the magnetic brush developing apparatus of the invention, indicated at 1 is a nonmagnetic developing sleeve, and at 2 a magnetic roller disposed in the interior of the developing sleeve 1. The sleeve 1 and the roller 2 are rotatable and are driven by variable-speed motors 21 and 22 respectively. Accordingly, each of these members is rotated at a variable speed. The developing sleeve 1 and the magnetic roller 2 may be driven at variable speeds by known speed varying means other than the variable-speed motors 21 and 22. Indicated at 3 is a hopper containing a magnetic developer 13.

With the rotation of the magnetic roller 2 in a clockwise direction, the magnetic developer 13 is transported on the sleeve 1 counterclockwise from a developer dispensing position A. The sleeve 1 of the present embodiment is also rotated at a low speed in the same direction as the magnetic roller 2. Since the force of transport resulting from the rotation of the magnetic roller 2 is greater than that given by the rotation of the sleeve 1, the developer 13 is transported counterclockwise while being subjected to the force of transport provided by the rotation of the sleeve 1.

At the downstream end of hopper, 3, i.e. at developer dispensing position A, is provided a bristle height adjusting plate 7 and a developer supplying plate 8, which are mounted on mounting member 6.

In opposed relation to the direction of rotation of the sleeve 1, the bristle height adjusting plate 7 for adjusting the bristle height of the magnetic brush is held in contact with the sleeve 1 at an adjusting position B on the path of transport of the developer 13 from the dispensing position A to a developing position C. Stated more specifically, the bristle height adjusting plate 7 has one end in pressing contact with the peripheral surface of the sleeve 1 on the rearward (upstream) side of the developing position C with respect to the counterclockwise direction. The bristle height adjusting plate 7 has a developer guide surface which is opposite to the surface thereof facing the sleeve 1 and which is at an acute angle with a tangent to the sleeve 1 extending in the direction of rotation of said sleeve.

The developing position C is the position where an unillustrated member for supporting the latent electrostatic image to be developed is closest to the sleeve 1.

Further, the developer supplying plate 8 for guiding the developer 13 towards the developer guide surface of the bristle height adjusting plate 7 is held in contact with the sleeve 1 at the dispensing position A in opposed relation to the direction of movement of the developer 13. The developer supplying plate 8 is positioned at an obtuse angle with respect to a tangent extending in the direction of rotation of said sleeve. The developer transported along the peripheral surface of the sleeve 1 on the rearward side of the adjusting position B with respect to the counterclockwise direction is scraped off by the developer supplying plate 8 from the sleeve peripheral surface and is thereby led to the developer guide surface of the bristle height adjusting plate 7 at the other end thereof opposite to the abovementioned end in pressing contact with the sleeve 1. The thus scraped (recovered) developer, of course, has added thereto a supply of developer 13 from the hopper 3. Indicated at 6 is a member for mounting the plates 7 and 8 so as to form a substantially L-shaped surface. In the present embodiment, the developer on the plates 7 and 8 are subjected to the magnetic action of the roller 2 and is therefore transported on these plates counterclockwise by the rotation of the magnetic roller 2.

The mounting member 6 and the plates 7 and 8 which are positioned close to the magnetic roller 2 must be made of a nonmagnetic material, preferably an insulating material, so as to reduce the loss due to eddy currents. Further, preferably the plates 7 and 8 have the smallest possible thickness so as to scrape the developer 13 off the sleeve 1 smoothly. In the present embodiment, the mounting member 6 is made from stainless steel, and the plates from a phosphor bronze sheet 50 μm in thickness.

With the developing apparatus described, the bristle height of the developer 13 is adjustable by varying the rotational speeds of the sleeve 1 and the magnetic roller 2. More specifically stated, the developer 13 located in the lower part of the developer layer on the sleeve 1 in the vicinity of the adjusting position B tends to move with the clockwise rotation of the sleeve 1 in the same direction, namely in a direction opposite to the direction of transport of the developer. Consequently, the above developer is subjected to the scraping action of the bristle height adjusting plate 7 and returned to the developer guide surface of the bristle height adjusting plate 7. This phenomenon results in a reduced bristle height. On the other hand, the force produced by the rotation of the magnetic roller 2 to transport the developer layer in its entirety in the counterclockwise direction increases with an increase in the speed of the rotation, acting to offset the above phenomenon. This phenomenon increases the bristle height. Accordingly, the bristle height decreases with an increase in the rotational speed of the sleeve 1 and increases with a decrease in the rotational speed of the magnetic roller 2.

Figure 4:
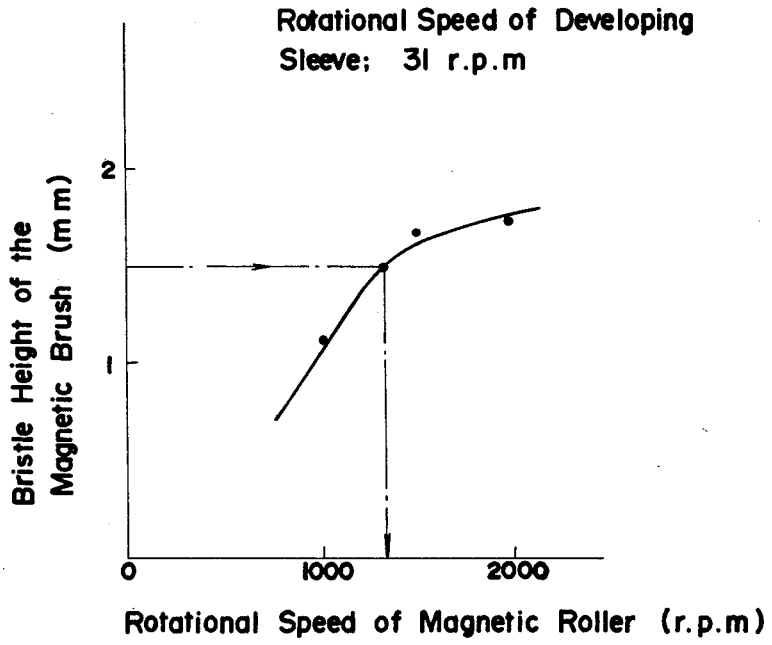
FIG. 4 (A) is a graph showing the relation between the rotational speed of the magnetic roller of the embodiment and the bristle height.
Figure 4:
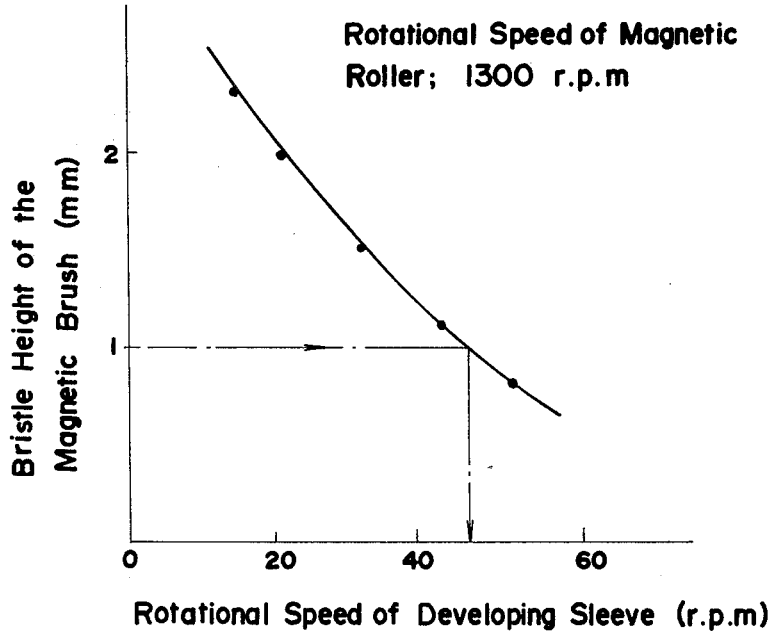

FIGS. 4(A) and 4(B) shows variations in the bristle height at varying rotational speeds of the sleeve 1 and the magnetic roller 2 in the present embodiment. The sleeve 1 has an outside diameter of 31 mm. The magnetic roller 2 has eight poles and a surface magnetic flux density of 1,000 gauss. The magnetic developer 13 used is a mono-component developer consisting only of a conductive magnetic toner.

FIG. 4(A) shows variations in the bristle height (plotted on the ordinate) with variations in the rotational speed of the magnetic roller 2 (plotted on the abscissa) when the sleeve 1 is driven at a constant speed. FIG. 4(B) shows variations in the bristle height (plotted on the ordinate) with variations in the rotational speed of the sleeve 1 (plotted on the abscissa) when the magnetic roller 2 is driven at a constant speed. In the present embodiment, for example, the bristle height is 1.5 mm with the sleeve 1 set for rotation at 31 r.p.m. by rotating the megnetic roller 2 at a speed of 1,300 r.p.m. Further when the magnetic roller 2 is rotated at 1,300 r.p.m., the bristle height is adjustable to 1 mm by rotating the sleeve 1 at 44 r.p.m. A given bristle height can be obtained, of course, by setting the rotational speeds of the sleeve 1 and the magnetic roller 2 in an optionally selected combination, namely, by varying the rotational speed of one or both of these members as desired.

The adjustment of the bristle height also alters the speed of transport of the developer 13, more particularly the speed of movement of the developer at the ends of the bristles for brushing the latent electrostatic image bearing surface. This results in the likelihood that the toner image developed will be blurred at the forward end at an increased speed of transport, or at the rear end at a reduced speed. It is therefore desirable to vary the bristle height alone without altering the speed of transport, as will be described below.

For example, when the bristle height is 1.5 mm due to the magnetic roller 2 being driven at 1,300 r.p.m. and the sleeve 1 at 30 r.p.m., the speed of transport of the developer 13 is 95 mm/sec. If it is desired at this time to adjust the bristle height to 1.2 mm without varying the rotational speed of the magnetic roller 2, the sleeve 1 is driven at an increased speed of 38 r.p.m., but the speed of transport of the developer 13 will then decrease to 50 mm/sec. In such as case, the bristle height can be adjusted to 1.2 mm while maintaining the speed of transport of the developer 13 at 95 mm/sec. by rotating the magnetic roller 2 at 1,900 r.p.m. and the sleeve 1 at 45 r.p.m.

FIG. 3 shows a rotational speed control circuit 23 by which the bristle height is adjustable while the transport speed is maintained at a constant value as described above and which is connected to the variable-speed motors 21 and 22 to relate the rotational speeds of the sleeve 1 and the magnetic roller 2 to each other according to a predetermined program. This circuit 23 includes a bristle height setting dial which is manually adjustable, and a pair of variable-resistors for controlling the rotational speed of the variable-speed motors 21 and 22. Each of these variable-resistors are coupled with the bristle height setting dial. Accordingly, the rotational speeds of the members are automatically altered by the bristle height setting dial, for adjusting the bristle height mantaining the speed of transport of the developer 13 at the same value.

Figure 5:
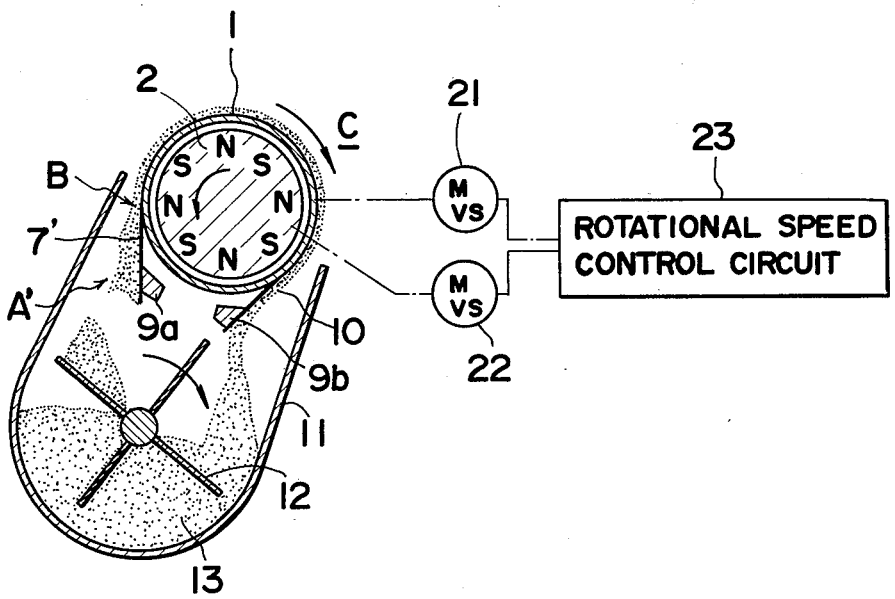
FIG. 5 is a diagrammatic sectional view showing another embodiment of the magnetic brush developing apparatus according to the invention.

FIG. 5 shows another embodiment of the magnetic brush developing apparatus according to this invention, including a developer tank 11 and a blade wheel 12 which is driven clockwise for supplying a developer 13 from a developer dispensing position A′, through a developer guide surface of a bristle height adjusting plate 7′, onto a sleeve 1. Indicated at 10 is a developer-removing plate by which the portion of developer 13 which has not been used for development is removed off the sleeve 1 and led into the tank 11. Designated at 9a and 9b are members for mounting the plates 7′ and 10 respectively. Thus, two plates are employed in this embodiment, one functioning as the bristle height adjusting plate 7 in the above-described embodiment and the other functioning to return unused developer to the developer supply.

In this embodiment, the sleeve 1 and a magnetic roller 2 are both driven counterclockwise. The developer 13 is adjusted to the desired bristle height at a point B where the forward end of the bristle height adjusting plate 7′ is in contact with the sleeve 1. Useful as the magnetic developer 13 is a mixture of a micro-carrier having particles of about 20 μm and a toner having particles of about 15 μm . Experiments have shown that the same relationships as illustrated in FIGS. 4(A) and 4(B) are achieved between the bristle height and the rotational speeds of the sleeve 1 and the magnetic roller 2.

As will be apparent from the foregoing description, the bristle height of the developer is adjustable in the magnetic brush developing apparatus of the invention merely by varying the rotational speed of the developing sleeve and the magnetic roller relative to each other, so that the developer is adjustable to a uniform bristle height free of any mechanical pressure or of caking or agglomeration, without necessitating a member, such as a restricting plate or roller, conventionally used for hindering the transport of the developer. Because of the above feature, the bristle height is adjustable uniformly although the developer is transported chiefly by the rotation of the magnetic roller. The bristle height is also adjustable delicately and with ease simply by varying the rotational speeds of the sleeve and the magnetic roller.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

We claim:

1. A magnetic brush developing apparatus for developing latent electrostatic images with a particulate magnetic developer which comprises (a) a rotatable non-magnetic developing sleeve, (b) first drive means connected to said sleeve for rotating said developing sleeve in a specified direction, (c) a magnetic roller rotatably disposed within the developing sleeve, (d) second drive means connected to said magnetic roller for rotating the magnetic roller in the same direction as the developing sleeve to transport said magnetic developer along the peripheral surface of the developing sleeve in a direction opposite to the direction of rotation of the developing sleeve, (e) a plate member having one end in pressing contact with the peripheral surface of said sleeve and a surface thereof forming a developer guide surface, which developer guide surface is at an acute angle with respect to a tangent to said sleeve, said tangent extending in the direction of rotation of said sleeve, for scraping developer particles moving in the direction of rotation of said sleeve, from said sleeve, (f) a developer supplying means for supplying developer particles to the peripheral surface of said sleeve to form bristles thereon and (g) a control means for controlling the rotational speeds of said sleeve and said roller with respect to each other, whereby the bristle height can be controlled while maintaining the developer speed substantially constant.

2. The apparatus according to claim 1 wherein said control means is connected to said first and second drive means.

3. The apparatus according to claim 1 wherein said developer supplying means supplies the developer particles, through said developer guide surface of said plate member, to the peripheral surface of said sleeve.

4. The apparatus according to claim 3 wherein said developer supplying means has second plate member having one end in pressing contact with the peripheral surface of said sleeve and a developer guide surface at an obtuse angle with respect to a tangent to said sleeve, said tangent extending in the direction of rotation of said sleeve, for scraping developer particles flowing countercurrent to the direction of rotation of said sleeve, from said sleeve and guiding the thus-scraped developer particles, through said developer guide surface of said second plate member, towards said developer guide surface of first plate member.

5. The apparatus according to claim 4 wherein said developer supplying means further comprises a mounting member for joining said developer guide surfaces of said first and second plate member.

6. The apparatus according to claim 1 wherein each of said first and second means comprises a variable-drive motor.

7. The apparatus according to claim 1 wherein said control means has a bristle height setting means for varying the length of the magnetic brush bristles formed by supply of the developer particles to said sleeve, while transporting the developer along the peripheral surface of said sleeve at substantially constant speed.

* * * * *